United States Patent [19]

Glöckler et al.

[11] 4,307,693

[45] Dec. 29, 1981

[54] FUEL INJECTION INSTALLATION

[75] Inventors: Otto Glöckler, Renningen; Ulrich Steinbrenner, Stuttgart, both of Fed. Rep. of Germany

[73] Assignee: Robert Bosch GmbH, Stuttgart, Fed. Rep. of Germany

[21] Appl. No.: 214,302

[22] Filed: Dec. 8, 1980

Related U.S. Application Data

[63] Continuation of Ser. No. 62,597, Jul. 31, 1979, abandoned.

[30] Foreign Application Priority Data

Jun. 30, 1979 [DE] Fed. Rep. of Germany ..... 2926490

[51] Int. Cl.[3] ..... F02M 55/00

[52] U.S. Cl. ..... 123/470; 123/469; 123/471

[58] Field of Search ..... 123/470, 469, 471; 239/533.11; 292/80, 163, 270, 256.6, 256.63

[56] References Cited

U.S. PATENT DOCUMENTS 3,776,209 12/1973 Wertheimer et al. ..... 123/470
3,841,277 10/1974 Schäfer ..... 123/470
4,143,625 3/1979 Kulke ..... 123/470
4,149,496 4/1979 Palma ..... 123/470

FOREIGN PATENT DOCUMENTS 2024324 1/1980 United Kingdom ..... 123/470

*Primary Examiner*—R. A. Nelli
*Attorney, Agent, or Firm*—Edwin E. Greigg

[57] ABSTRACT

A fuel injection installation for internal combustion engines having a plurality of injection valves for supplying fuel to the engine. Each injection valve is sealed to fuel distributing line and to either the intake manifold of the engine, or to the cylinder head of the engine, by at least one O-ring, each O-ring being braced only in the radial direction. Each injection valve is fixed in an axial direction on the fuel distributing line by means of a fastening plate yielding in the radial direction and embodied as bracket-like, which is insertable through appropriately shaped recesses in each insertion nipple on the fuel distributing line and can be snapped into an annular groove of each injection valve. As a result, there is assured not only a secure connection between the fuel distributing line and the injection valves which compensates for axial clearances required for manufacture, but also rapid mounting or dismounting of the fuel injection installation.

2 Claims, 2 Drawing Figures

FUEL INJECTION INSTALLATION

This is a continuation of application Ser. No. 62,597, filed July 31, 1979 now abandoned.

BACKGROUND OF THE INVENTION

The invention relates to a fuel injection installation, and in particular, the invention relates to an installation for fuel injection valves, each mounted, at one end, to a fuel distributing line, and at the other end, to the intake manifold of the engine adjacent a respective intake valve of the engine.

A fuel injection installation in which each of the injection valves are inserted, at one end, into appropriate openings in the intake manifold, and, at the other end, into insertion nipples of a fuel distributing line is known. The valves are firmly braced in the axial direction due to their mountings in the manifold openings and the insertion nipples. In such a system, the axial bracing of the injection valves are known to vary, however, because of the clearances required for manufacture. Because of these clearances, the valves do not always fit properly, and this is a disadvantage because it results in undersirable noises. A further disadvantage is that when the installation is mounted on the engine all the injection valves must be inserted individually and sequentially into their respective branches of the intake manifold and into the insertion nipple of the fuel distributing line, because means for fastening the injection valves to the fuel distributing line are not provided.

OBJECTS AND SUMMARY OF THE INVENTION

It is a principal object of the present invention to improve the known fuel injection installations wherein the injection valves are mounted to a fuel distributing line and either the intake manifold of the engine or the cylinder head. With the improved fuel injection installation according to the present invention, an advantage over the prior art is realized in that there is increased security against loosening of the plug connection between the fuel distributing line and the injection valves and also in that a more rapid mounting is possible. The injection valves are coupled with the fuel distributing line by means of securing elements, and can now be inserted and mounted on the engine simultaneously as a unit which is separately accessible, examined and mounted. Axial bracing is not required and the best possible damping of fluctuations and thus the best possible suppression of undesirable noises results.

Radial sealing between a connecting stud of the valve and an insertion nipple of the fuel distributing line on one end, and between the nozzle and the opening in the intake manifold or cylinder on the other end, permits compensation for the required manufacturing clearances.

The invention will be better understood and further objects and advantages thereof will become more apparent from the ensuing detailed description of a preferred embodiment taken in conjunction with the drawing.

BRIEF DESCRITPION OF THE DRAWING

FIG. 1 represents a preferred exemplary embodiment of a fuel injection installation according to the invention. Only one of the injection valves and its mounting are shown; and FIG. 2 is a section taken along the line II—II of FIG. 1.

DESCRIPTION OF THE PREFERRED EMBODIMENT

Figure 1:
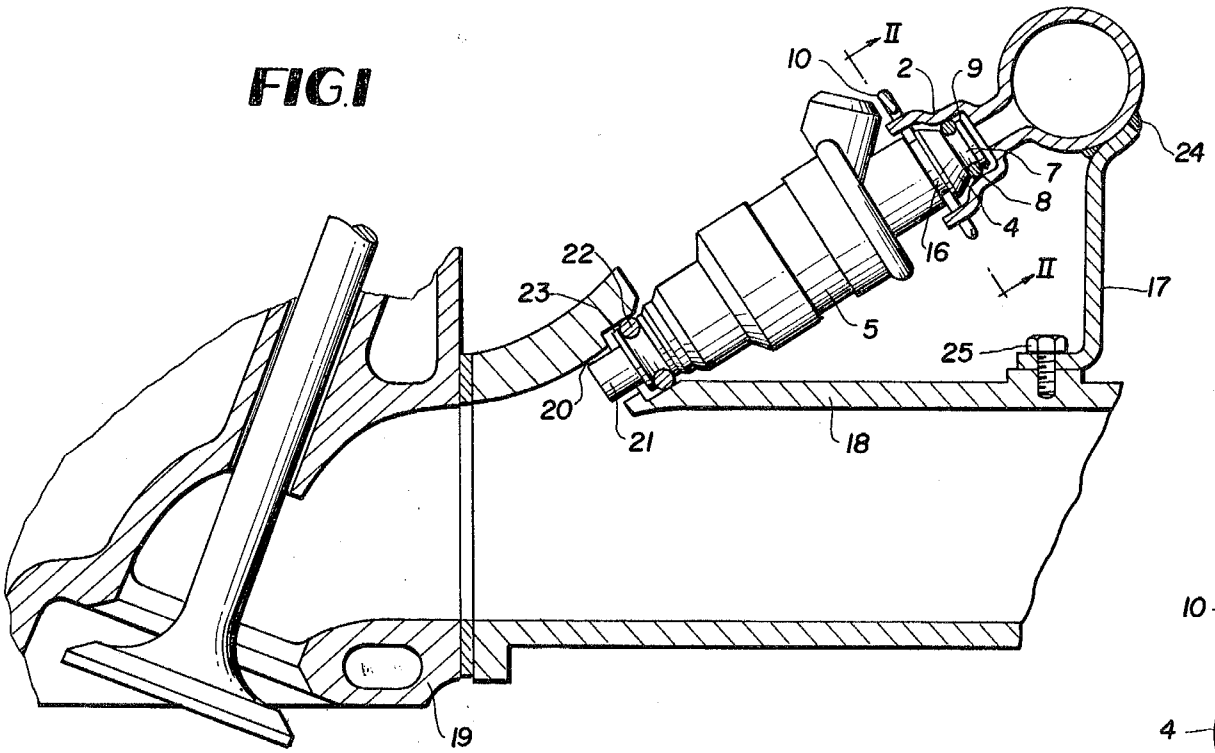
Figure 2:
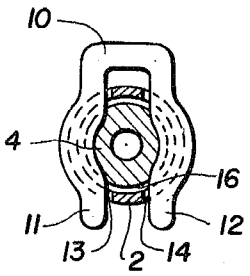

Turning now to FIG. 1, a fuel injection installation for operating an internal combustion engine (not shown) is illustrated. The installation includes a fuel distributing line 1 of rigid shape, made, for example, of metal, which communicates, at one end, with the pressure side of a fuel supply pump (not shown), and at the other end, via a pressure controller (also not shown) with the intake side of the fuel supply pump and thus with a fuel tank. Connected to the fuel distributing line 1 are insertion nipples 2, of which only one is shown, through which fuel can flow out of the fuel distributing line 1. A connecting stud 4 of an injection valve 5 can be inserted into each insertion nipple 2. In the exemplary embodiment shown, an electromagnetically actuatable injection valve 5 is shown by way of example, which can be triggered in accordance with operational conditions of the internal combustion engine in a known manner by an electronic control device (not shown). The connecting stud 4 is provided with an annular groove 7, in which is disposed an elastic sealing element, preferably an O-ring 8. When the connecting stud 4 is inserted into the insertion nipple 2, the sealing element 8 comes into contact with the sealing wall of a counterbore 9 in the interior of the insertion nipple 2 and is thus braced in a radial direction, so that fuel leakage between the insertion nipple 2 and the connecting stud 4 is precluded. The axial fix of the injection valve 5 to the fuel distributing line 1, that is, in the insertion nipple 2, is accomplished by means of a securing element which is embodied as a bracket-shaped fastening plate 10 (see FIG. 2 as well). The fastening plate 10 is provided with two radially yielding arms 11 and 12. In the mounting assembly, the fastening plate 10 grasps the injection valve 5 through appropriately formed recesses 13, 14 in the insertion nipple 2, by snapping into an annular groove 16 of the injection valve, which is preferably located on the connecting stud 4. Thus the axial play between the recesses 13, 14 and the fastening plate 10 on the one hand and between the annular groove 16 and the fastening plate 10 on the other is intended to be kept to a minimum, in order to assure a precise axial fix between the injection valve 5 and the fuel distributing line 1 without bracing the O-ring 8 in the axial direction. The fuel distributing line 1, with the injection valves 5 secured thereon by the fastening plates 10, comprises a separately accessible unit which can also be separately examined and mounted. The distributing line and injection valves as a subassembly can be installed to the intake manifold portion 18 by means of holders 17 either directly on the internal combustion engine as shown, or indirectly thereof via interposed damping elements not shown. Openings 20 are provided for the injection valves 5 either in the intake manifold portion 18 as shown, or in the cylinder head portion 19 of an internal combustion engine. The injection valves 5 can be inserted with nozzles 21 remote from the connecting studs 4. Fuel can be injected into the intake manifold portion 18 or the cylinder head portion 19 of the engine via these nozzles 21. At least one elastic sealing element 22, preferably an O-ring 22, is disposed on the nozzle 21 of each injection valve 5. Upon insertion into the opening 20, this O-ring 22 is supported against the wall of a counterbore 23 of the opening 20 and is radially braced against the counterbore wall in order to assure the sealing action. An axial bracing of the O-ring 22 is not necessary.

In order to easily insert the injection valve 5 into the opening 20 and the nipple 2, the holder 17 may be welded at 24 or otherwise rigidly secured to the fuel line 1. The opposite end of holder 17 is then secured by a screw 25 which screws into the intake manifold or by a clamp which may be screwed to the manifold. Such an arrangement permits one to secure one end of the injection valve in the nipple 2 and then insert the other end in the opening 20 and then secure the holder 17 to the manifold by use of the screw.

The mounting of the injection valves 5 between the fuel distributing line 1 and the intake manifold portion 18 or cylinder head portion 19, without axial bracing of the injection valves 5, permits not only compensation for axial clearances between the injection valves, but also reduces a transmission of fluctuations and thus serves to reduce noise.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A fuel injection installation for internal combustion engines having an intake manifold and a plurality of cylinder heads, the installation comprising:

a common fuel distributing line of rigid construction including a plurality of insertion nipples each receiving one end of a fuel injection valve;

at least two elastic sealing elements;

a plurality of fuel injection valves, each including, at one end, a connecting stud sealingly engaged by at least one of said sealing elements with a respective insertion nipple, and at the other end, a nozzle sealingly engaged by at least one other of said sealing elements selectively in an opening in the intake manifold or the cylinder head, bracket holder means which yields in the radial direction with respect to the axis of said injection valve for bracing said sealing elements in the radial direction due to the connecting stud engagement and the nozzle engagement; and a plurality of securing elements, each of which partially surround a respective insertion nipple and injection valve to the insertion nipple and thus to the distributing line, such that the injection valve is fixed in the axial direction.

2. A fuel injection installation as claimed in claim 1 wherein each of said securing elements include two radially yielding arms that partially surround said insertion nipple.

* * * * *